7/2/85 XR 4,526,679

United States Patent [19]

Litzinger

[11] Patent Number: 4,526,679

[45] Date of Patent: Jul. 2, 1985

[54] REMOVAL OF LOW MELTING PARTICLES FROM UNGROUND COAL LIQUEFACTION RESIDUE

[75] Inventor: Ronald L. Litzinger, Long Beach, Calif.

[73] Assignee: Texaco Inc., White Plains, N.Y.

[21] Appl. No.: 528,829

[22] Filed: Sep. 2, 1983

[51] Int. Cl.[3] ..... B03B 1/02; B07B 1/00

[52] U.S. Cl. ..... 209/3; 209/5; 209/11; 209/46; 209/238; 44/1 R; 44/10 R; 23/313 R; 264/117; 264/122; 428/402; 428/408

[58] Field of Search ..... 44/1 R, 10 R; 209/4, 209/238, 5, 3, 11, 45, 46; 264/117, 122, 124–126; 106/273 R; 428/408; 23/313

[56] References Cited

U.S. PATENT DOCUMENTS

| | | | |
|---|---|---|---|
| 2,468,472 | 4/1949 | Townsend | 209/11 |
| 3,097,160 | 7/1963 | Rich | 209/46 X |
| 3,114,703 | 12/1963 | Brison | 209/46 X |
| 3,306,958 | 2/1967 | Gidlow | 264/117 X |
| 3,616,167 | 10/1971 | Gosden | 264/126 X |
| 3,852,046 | 12/1974 | Brown | 44/1 R |
| 3,920,418 | 11/1975 | Rice | 48/197 R X |
| 4,181,502 | 1/1980 | Weber et al. | 44/10 C |

*Primary Examiner*—Frank W. Lutter
*Assistant Examiner*—Thomas M. Lithgow
*Attorney, Agent, or Firm*—Robert A. Kulason; Carl G. Seutter

[57] ABSTRACT

A mixture of low melting particles and high melting particles is heated to a temperature above the melting point of the low melting particles and below the melting point of the high melting particles thereby melting the low melting particles and forming a bond between the low melting particles and the high melting particles which bond is strengthened on cooling, the resulting agglomerate containing the low melting particles being separated from the unbonded high melting particles.

8 Claims, 2 Drawing Figures

FIG. 1
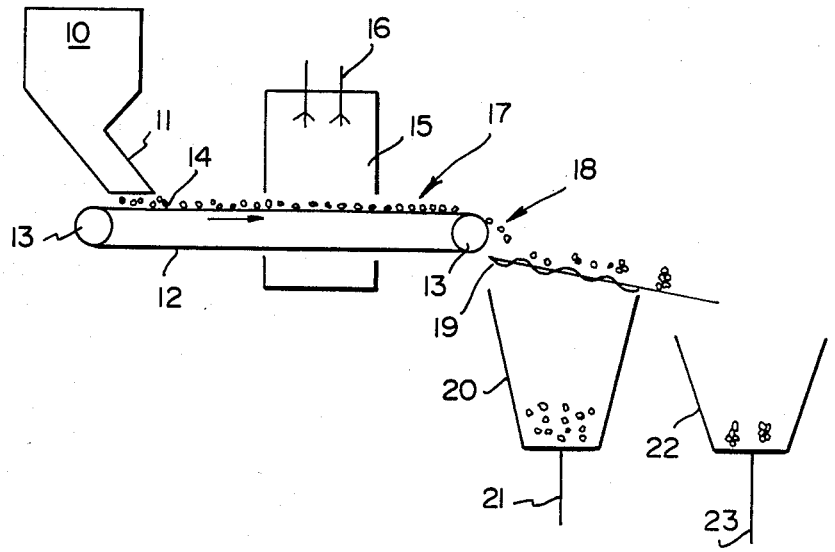
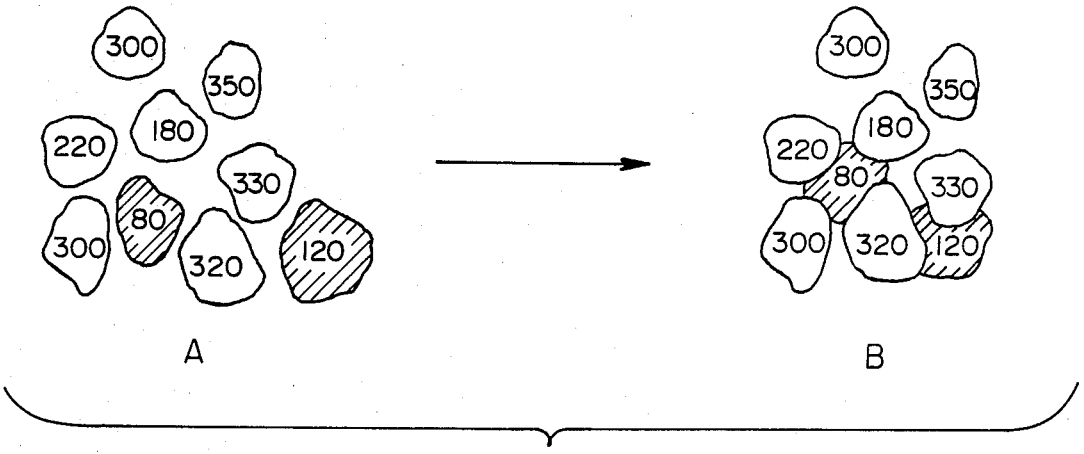
FIG. 2

REMOVAL OF LOW MELTING PARTICLES FROM UNGROUND COAL LIQUEFACTION RESIDUE

FIELD OF THE INVENTION

This invention relates to a process for treating a solid mixture containing components of wide range of softening temperatures and particularly mixtures containing low melting particles and high melting particles. More particularly it relates to a process for treating a coal liquefaction residue.

BACKGROUND OF THE INVENTION

As is well known to those skilled in the art, solid carbonaceous materials, including coals of high and low rank, may be subjected to various processes to convert at least a portion of the carbon present in the solid to a liquid form; and these processes for hydrogenation of coal are commonly termed H-coal processes.

In these processes, finely powdered coal, typically of size such that at least 100 w% passes through a 40 mesh US Standard sieve is contacted (in the form of a slurry) with hyrogen at 350° C.–600° C., say 450° C. and 1000–2500 psig, say 2000 psig to form hydrocarbons characterized by increased hydrogen content. Illustrative of processes for upgrading coal are those disclosed in U.S. Pat. No. 2,221,886; 2,860,101; and 3,341,447.

Product hydrocarbon liquids are separated by distillation leaving a hydrophobic solid typically characterized as follows:

TABLE

| Property | Typical Value |
|---|---|
| w % carbon | 16 |
| density g/cc | 1.4 |
| boiling point | above 1300° F. |
| Particle size | 1–2 inch flakes |

It is desirable to use this H-coal residue as a charge to a gasification reaction i.e. to convert it to a synthesis gas (containing carbon monoxide and hydrogen) by partial combustion; but this has proven to be difficult because of the problems encountered during feed preparation. The synthetic H-coal is a composition which has properties totally unlike those of other carbonaceous materials; and these render it particularly and uniquely difficult to handle.

It is found that if H-coal be subjected to grinding and mixing with water in an attempt to form a slurry suitable for use as feed to gasification, the slurry is characterized by problems which render this difficult-to-impossible.

These difficulties arise at least in part because the H-coal residues contain low melting particles or flakes admixed with particles of higher melting point. When the mix is ground, as is done to prepare it for use as feed to a coal gasification operation, it is found that the heat of grinding melts the low melting point components during grinding. The melt gums up the impact mill to a point at which it is inoperative.

It is an object of this invention to provide a process for treating a mixture containing low melting particles and high melting particles. Other objects will be apparent to those skilled in the art.

STATEMENT OF THE INVENTION

In accordance with certain of its aspects, this invention is directed to a process for treating a mixture containing low melting particles and high melting particles which comprises heating said low melting particles in said mixture to a temperature above the melting point of said low melting particles and below the melting point of the high melting particles;

contacting said low melting particles at temperature above their melting point with at least one high melting particle at temperature below its melting point thereby forming an agglomerate of at least one low melting particle and at least one other particle; and recovering said mixture containing agglomerate of at least one low melting particle and at least one other particle.

DESCRIPTION OF THE INVENTION

The mixture containing low melting particles and high melting particles which may be charged to the process of this invention may be derived from various sources. One source of particular interest is the by-product residue from H-coal treating wherein coal is hydrogenated to produce hydrocarbon liquids. The H-coal residue may be characterized by the following properties:

TABLE

| Property | Value | Preferred |
|---|---|---|
| w % carbon | 9–20 | 16 |
| density g/cc | 1.2–1.5 | 1.4 |
| boiling point (°F.) | above 1300 | above 1300 |
| particle size (inches) | 1–2 | 1 |
| phenolic compounds w % | 2–10 | 5 |

Detailed analysis of the particles of the charge H-coal residue indicates that the charge may be considered to be made up to two principal components:

(i) a low melting (having a softening temperature below the maximum grinding temperature) portion typically having a melting point below about 150° F. and commonly 70° F.–150° F., say about 100° F.—this portion being present in amount of 1 w%–5 w%, say about 1 w% of the total; and (ii) a higher melting (having a softening temperature above the maximum grinding temperature) portion typically having a melting point above about 150° F. and commonly 150° F.–400° F., say about 370° F.,—this portion being present in amount of 95 w%–99 w%, say about 99 w% of the total.

Typical ultimate analyses of the high melting portion and the low melting portion may be as follows:

TABLE

| Component | High Melting | Low Melting |
|---|---|---|
| C | 67.74 | 75.31 |
| H | 4.29 | 6.55 |
| N | 1.21 | 1.16 |
| S | 2.55 | 1.60 |
| Ash | 21.30 | 13.45 |
| O (by dif.) | 2.91 | 1.93 |

It will be apparent that the composition of this typical charge mixture may vary considerably. In the case of the preferred H-coal residue charge, it may contain a wide range of compounds of high molecular weight. The melting point of such a composition may be defined as the temperature (or range of temperature) at which the surface thereof becomes sufficiently tacky to adhere to adjacent particles i.e. the temperature or range at which the particles cease to be free-flowing. Clearly the melting point so defined may be in the softening range of the lowest melting of the several components: and it is not necessarily equivalent to the melting point of any pure component thereof. It is measured by ASTM D-36 "Softening Point of Bituminous Material—Ring and Ball Method".

In practice the process of this invention, the mixture of low melting particles and high melting particles may be heated to a temperature above the melting point of the low melting particles and below the melting point of the high melting particles. It will be apparent to those skilled in the art that the temperature to which heating is effected will vary as the melting point of the particles varies. Commonly it is found that H-coal residues may be heated to 150° F.–200° F., say about 150° F.

At this typical temperature, the low melting particles may be found to have a substantially tacky semi-liquid surface and the high melting particles may be found to be below their melting point and thus be in essentially solid, non-tacky form.

Heating may be effected by passing the body of charge particles (of particle size of 1–2 inches, say about 1.5 inches) in a thin layer, typically 4–8 inches, say about 6 inches deep along a path wherein they are heated by a convention heater or a radiant heater. In another embodiment, the body of charge particles may be contacted with hot gases. In still another embodiment, the body of charge particles may be suspended in a fluidizied bed in a vessel.

It is found that the low melting particles melt or fuse under the conditions of heating; and as they contact adjacent particles including higher and lower melting particles, they become bonded thereto to form an agglomerate of larger size. Although not necessary, it may be found to be desirable to agitate the body of particles during agglomeration—as occurs in the case of the fluidized bed.

The low melting particles are typically maintained at temperature above their melting point for 2–5 minutes, say 3 minutes during which time agglomeration occurs. At the end of this time, the agglomerates may be cooled to a temperature below the melting point of the low melting particles in order to fix the agglomerates in their agglomerated state and to minimize subsequent deterioration into smaller clusters.

It is found that the agglomerates may contain two or more particles. The particle clusters commonly contain a plurality of low melting particles and a larger number of high melting particles bonded together to form a matrix. The agglomerates, clusters, or matrices will commonly be of particle size 2–15 times say 6 times the average particle size of the particles from which they are formed.

In typical operation, the charge H-coal residue may be of average particle size of about 1.5 inches and the agglomerates prepared therefrom may be of average particle size of about 4–15 inches, say 6 inches.

The agglomerates may be removed from the body of particles as by screening. Separation of the aggregates yields a residual body of high melting particles which commonly contains 90 w%–98 w%, say 97.5 w% of the charge mixture. The body of high melting particles after separation commonly contains less than about 1 w%, of low melting particles. The agglomerates typically contain 30–50 w%, say 40 w% low melting particles and 50–70 w%, say 60 w% high melting particles.

The so-prepared body of high melting particles may be recovered and further treated in accordance with the ultimate use to which they are to be put. When they are to be passed to gas generation, as in a preferred embodiment, they may be subjected to crushing, milling, and slurrying and then be passed to gasification.

Practice of the process of this invention will be apparent to those skilled in the art from the following description of a preferred embodiment which represents the best mode presently known to me of carrying out the process of this invention.

DESCRIPTION OF THE DRAWING

The drawing shows in FIG. 1 a schematic representation of a flow sheet according to which the process of this invention may be carried out. FIG. 2 shows an illustrative body of particles before and after treatment by the process of this invention.

DESCRIPTION OF THE PREFERRED EMBODIMENT

In practice of the process of this invention according to a preferred embodiment, the charge hydrophobic solid may be an H-coal residue characterized as follows:

TABLE

| Property | Value |
|---|---|
| w % carbon | 16 |
| density g/cc | 1.4 |
| boiling point | above 1300° F. |

Analysis of this typical charge indicates that it contains about 1 w% of particles having a melting point of about 70° F.–150° F. and about 99 w% of particles having a melting point of about 150° F.–400° F. The particle size of the particles is about 1–2 inch flakes.

In practice of the process of this invention, a body of charge particles of the above properties is passed from feed hopper 10 through chute 11 onto moving belt 12 which is mounted on rollers 13. The particles are deposited on the belt 12 as a layer 14 about 6 inches in thickness. The layer is passed into heating zone 15 heated by combustion of gases entering through line 16. The temperature of the bed or layer within the heating zone 15 is controlled to be about 150° F. which is above the melting point of the low melting particles in the bed and below the melting point of the high melting particles in the bed or layer.

As the layer passes through heating zone 15, the low melting particles melt and become tacky. They bond or agglomerate with adjacent particles to form larger agglomerates. The layer leaves the heating zone 15 and is passed through a cooling zone 17 which in the preferred embodiment is ambient air. Here the low melting particles (now a portion of an agglomerate or cluster) freeze into a rigid configuration.

The so-cooled bed or layer is discharged from the moving belt at 18 and passed onto screen 19 sized to permit the smaller particles of high melting point to drop into collecting bin 20 from which they may be discharged through line 21.

The agglomerates of larger particle size are passed over screen 19 to agglomerate collection bin 22 from which they may be removed through line 23.

The product recovered through line 21 (97.5 w% of the charge) has a melting (softening) point of 150° F.–400° F. and an average particle size of 1–2 inch flakes. The agglomerates, of average particle size of 4–8 inches, recovered through line 23 (2.5 w% of the charge) include particles of melting (softening) point of 150° F.–400° F. bounded by soft material with a softening point of 70° F.–150° F.

The mode of formation of the agglomerates may be apparent from FIG. 2. FIG. 2A shows a plurlity of particles of a typical charge, the numbers designating the initial melting point in degrees Fahrenheit. The low melting particles, having a melting point below 150° F., are shown cross-hatched.

FIG. 2B shows the agglomerate which may be formed after the low melting particles have been heated to above 150° F. It will be apparent that the particles melting above 150° F. have essentially maintained their shape. The particles melting below 150° F. have lost a portion of their shape and in some instances may no longer exist as discrete particles. These low melting particles serve as the glue which bonds them to at least one other particles (which may be a high melting particle or a low melting particle). In the configuration shown, each of several low melting particles have become bonded to several high melting particles to form in this instance a cluster, aggregate, or agglomerate containing a plurality of high melting particles bonded together by at least one solidified melted low melting particle i.e. a low melting particle which has been melted and then re-solidified.

Although this invention has been illustrated by reference to specific embodiments, it will be apparent to those skilled in the art that various changes and modifications may be made which clearly fall within the scope of this invention.

I claim:

1. The process for treating a feed mixture containing a minor proportion of low melting particles and a major proportion of high melting particles which comprises heating said feed mixture to a temperature above the melting point of the low melting particles in said mixture and below the melting point of the high melting particles in said feed mixture;

contacting said low melting particles at temperatures above their melting point with at least one high melting particle at temperature below its melting point thereby forming an agglomerate of at least one low melting particle and at least one high melting particle within a bed of high melting particles;

separating said agglomerate from said bed of high melting particles; and recovering said bed of high melting particles.

2. The process for treating a feed mixture containing a minor proportion of low melting particles and a major proportion of high melting particles as claimed in claim 1 wherein said bed is cooled to a temperature below the melting point of said low melting particles prior to separating said agglomerate from said bed of high melting particles.

3. The process for treating a mixture of coal liquefaction residue containing a minor proportion of low melting particles and a major proportion of high melting particles which comprises heating said mixture to a temperature above the melting point of the low melting particles in said mixture and below the melting point of the high melting particles in said mixture;

contacting said low melting particles at temperature above their melting point with at least one high melting particle at temperature below its melting point thereby forming an agglomerate of at least one low melting particle and at least one other particle within a bed of high melting particles;

separating said agglomerate from said bed of high melting particles; and recovering said bed of high melting particles.

4. The process for treating a mixture of coal liquefaction residue containing a minor proportion of low melting particles and a major proportion of high melting particles as claimed in claim 3 wherein said low melting particles melt at temperature below about 150° F.

5. The process for treating a mixture of coal liquefaction residue containing a minor proportion of low melting particles and a major proportion of high melting particles as claimed in claim 3 wherein said high melting particles must at temperature above about 150° F.

6. The process for treating a mixture of coal liquefaction residue containing a minor proportion of low melting particles and a major proportion of high melting particles as claimed in claim 3 wherein said low melting particles are present in said mixture of coal liquefaction residue in amount of about 1 w%–5 w% of the total of said residue.

7. The process for treating a mixture of coal liquefaction residue containing a minor proportion of low melting particles and a major proportion of high melting particles as claimed in claim 3 wherein said mixture of coal liquefaction residue has a particles size of about 1–2 inches.

8. The process for treating a mixture of coal liquefaction residue containing a minor proportion of low melting particles and a major proportion of high melting particles as claimed in claim 3 wherein said agglomerate has a particle size of about 4–15 inches.

* * * * *

UNITED STATES PATENT AND TRADEMARK OFFICE

CERTIFICATE OF CORRECTION

PATENT NO. : 4,526,679

DATED : 7/2/85

INVENTOR(S) : Ronald L. Litzinger

It is certified that error appears in the above-identified patent and that said Letters Patent is hereby corrected as shown below:

Column 5, line 10, correct the spelling of

--- plurality ---;

Column 6, line 34, cancel "must", insert

--- melt ---

Signed and Sealed this

*Fifteenth* Day of *October 1985*

[SEAL]

*Attest:*

*Attesting Officer*

DONALD J. QUIGG

*Commissioner of Patents and Trademarks—Designate*